US006367172B2

(12) United States Patent
Hernandez

(10) Patent No.: US 6,367,172 B2
(45) **Date of Patent: *Apr. 9, 2002**

(54) FLEX SOLE

(75) Inventor: Homar Hernandez, Boca Raton, FL (US)

(73) Assignee: BBC International Ltd., Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/373,122

(22) Filed: Aug. 12, 1999

Related U.S. Application Data

(63) Continuation-in-part of application No. 09/347,051, filed on Jul. 2, 1999.

(51) Int. Cl.[7] ..... A43B 13/18

(52) U.S. Cl. ..... 36/103; 36/28; 36/30 R; 36/32 R

(58) Field of Search ..... 36/103, 28, 30 R, 36/32 R, 35 R, 29

(56) References Cited

U.S. PATENT DOCUMENTS

| | | | | | |
|---|---|---|---|---|---|
| 1,994,681 | A | | 3/1935 | Blumenfeld | 36/28 |
| 2,981,011 | A | * | 4/1961 | Lombardo | |
| 4,133,118 | A | | 1/1979 | Khalsa et al. | |
| 4,245,406 | A | | 1/1981 | Landay et al. | 36/14 |
| 4,316,332 | A | * | 2/1982 | Giese et al. | |
| 4,316,335 | A | * | 2/1982 | Giese et al. | |
| 4,502,234 | A | * | 3/1985 | Schaefer et al. | |
| 4,546,556 | A | * | 10/1985 | Stubblefield | |
| 4,663,865 | A | | 5/1987 | Telecemian | 36/114 |
| 4,706,316 | A | * | 11/1987 | Tanzi | |
| 4,783,910 | A | | 11/1988 | Boys, II et al. | 36/107 |
| 4,794,707 | A | | 1/1989 | Franklin et al. | 36/107 |
| 4,823,483 | A | * | 4/1989 | Chapnick | |
| 5,467,536 | A | * | 11/1995 | Ramer et al. | |
| 5,667,738 | A | * | 9/1997 | Krajcir | |
| 5,768,806 | A | * | 6/1998 | Parisotto | |
| 5,787,609 | A | * | 8/1998 | Wu | |
| 5,832,634 | A | | 11/1998 | Wong | 36/107 |
| 5,839,208 | A | * | 11/1998 | Huang | |
| 5,896,608 | A | * | 4/1999 | Whatley | |
| 9,347,051 | | | 7/1999 | Hernandez | |
| 5,979,079 | A | * | 11/1999 | Krajcir | |

FOREIGN PATENT DOCUMENTS

| | | |
|---|---|---|
| EP | 0 278 031 A1 | 8/1988 |
| EP | 0 408 793 A1 | 1/1991 |
| WOPCT/US99/23249(App | | 10/1999 |
| WOPCT/US99/24026(App | | 10/1999 |

OTHER PUBLICATIONS

U.S. application No. 09/347,051, Hernandez, filed Jul. 2, 1999.

* cited by examiner

*Primary Examiner*—Ted Kavanaugh
(74) *Attorney, Agent, or Firm*—Darby & Darby

(57) ABSTRACT

A shoe designed for active wear is described having a distinctive outsole. The outsole has a peripheral wall delimiting a plantar region, a heel region and an arch region of the outsole. A cavity formed in the plantar region has a shape including a floor and an inner periphery defined by a plurality of ribs that form a structure with a series of combs articulating with the peripheral wall of the outsole. A cushioning pad is located within the cavity and molded-in-place to the inner periphery and the floor of the cavity to form an integral functional part of the outsole.

21 Claims, 4 Drawing Sheets

FLEX SOLE

The present invention claims priority to, and is a continuation-in-part of, U.S. patent application Ser. No. 09/347,051 entitled FLEX SOLE and filed on Jul. 2, 1999 still pending, which is commonly assigned as the present application and incorporated herein by reference.

TECHNICAL FIELD

Background

Footwear can be designed to provide a variety of stylistic and functional benefits. One of these sought-after utilitarian advantages is comfort of the wearer during various activities. Particularly when walking or running, flexibility and shock absorption of the shoe greatly determine the amount of comfortable support experienced by the wearer. Shoes normally worn for active use, e.g., extensive walking or fitness sports, typically consist of an upper (of canvas, leather or other supple fabric material) joined to an outer sole (of rubber, leather or other durable material) having a bottom that contacts the ground. The inner surface of the outer sole, i.e., outsole, has distinct regions that contact corresponding portions of the wearer's foot sole. For example, the outsole can have distinct heel, arch and plantar regions that underlie the respective portions of the foot—these regions may be specifically adapted to provide a given functional benefit to the parts of the foot that are supported by them. A highly flexible inner sole, i.e., insole, is usually provided that directly contacts the wearer's foot and is positioned between the foot and the upper surface of the outsole. The insole has an upper surface of fabric or soft leather to give added comfort and breathability to the sole of the foot. The outsole needs to embody both flexible and durable characteristics, to resist wear from pavement and torsional stresses, also to cushion shock from impact due to foot motion.

Others have sought to provided added shock absorption to the outsole by providing added layers or members in various regions of the outsole. For example, U.S. Pat. No. 4,783,910 to Boys, II et al., provides a midsole with discrete heel capsule to cushion G-forces, in conjunction with an anti-torsion heel member. U.S. Pat. No. 1,994,681 to Blumfeld, U.S. Pat. No. 4,245,406 to Landay, et al., and U.S. Pat. No. 5,839,208 to Huang disclose outsoles having inner cavities presenting patterns of ribbed structures that are joined to sides of the outsole. Such structures are said to enhance the shock-absorbing support function of the outsole and its torsional stability.

U.S. Pat. No. 4,794,707 to Franklin, et al., shows a midsole with an internal dynamic rocker element disposed in the forefoot of the midsole, said to enhance walking comfort.

U.S. Pat. No. 4,663,865 to Telecemian has a first set of ribs that extend from within the heel cavity and a second set of ribs extending diagonally through the arch cavity, both sets dovetailing into the floor of the plantar cavity. A resilient cushion is located in the plantar cavity, being shaped and sized corresponding to that cavity. However, the separate cushion does not form an integral part of the inner plantar cavity of the outsole, but rather functions as an integral component of the midsole than of the outsole. Moreover, such a cushion requires additional steps to assemble together with the midsole during the manufacturing process.

Therefore it is desirable to provide a strategically positioned cushioning support member in a strategic functional region of the outsole cavity, which member functions integrally with the outsole in cushioning shock to a given area of the foot.

It is further desirable to provide a cushioning member that is fabricated as part of the inner cavity of the outsole, so that the member is joined thereto and functions integrally with the outsole, versus other components of the shoe during wear.

It is still further desirable to provide an integral cushioning member that functions together with other stabilizing members found within the inner cavity of the outsole.

SUMMARY

According to the subject invention, an outer sole of a shoe unit has a peripheral wall delimiting a plantar, heel and arch region of the outsole. A separate, flexible cushioning pad of polymeric material is molded in place within one or more of the heel, plantar and arch regions of the outsole.

In a preferred embodiment, the outsole is made of a flexible polymeric material having a given density and the pad is molded in place within the plantar region, the pad being formed of a different polymeric material th an the outsole, such that the plantar and heel regions are of differing densities, respectively.

In a preferred embodiment, an inner cavity is formed in at least one of the plantar, heel and arch regions, the cavity including a floor. A separate cushioning pad element is located within the cavity, wherein the pad is molded-in-place to the floor within the cavity to form an integral functional part of the outsole.

In a preferred embodiment, the cavity and pad are located in the plantar region of the outsole.

In another preferred embodiment, a plurality of ribs form a structure defining a series of combs that articulate with the peripheral wall of the outsole, the arrangement further delimiting an inner periphery of the cavity, wherein the pad is joined to that inner periphery. In a further preferred embodiment, the cavity and pad are shaped to correspond to the contours of the peripheral walls of the outsole.

In another preferred embodiment, a plurality of ribs form a structure defining a series of open combs that extend transversely across the outsole and articulate with the peripheral wall of the outsole within one or more of the heel, arch and plantar regions. It is further preferred that the pad be molded in place within the combs of the plantar region.

An advantage of the present invention is that a strategically positioned cushioning support member can function in a strategic region of the outsole, as an integral part of the outsole, in cushioning shock to a given area of the foot.

Another advantage of the present invention is that the cushioning member can be fabricated as part of the inner cavity of the outsole, so that the member is joined thereto and functions integrally with the outsole, versus other components of the shoe during wear.

Another advantage of the present invention is an integral cushioning member that functions together with other stabilizing members found within the inner cavity of the outsole.

A further advantage of the present invention is enhanced support and shock absorption by providing an outsole with selected cushioning capacity where needed, without the necessity of a separately engineered midsole assembly.

Other objects and advantages of the present invention will become apparent to those skilled in the art, by a careful examination of the following Specification, Claims and Drawings wherein reference numerals correspond to like descriptions in the Specification.

Figure 1:
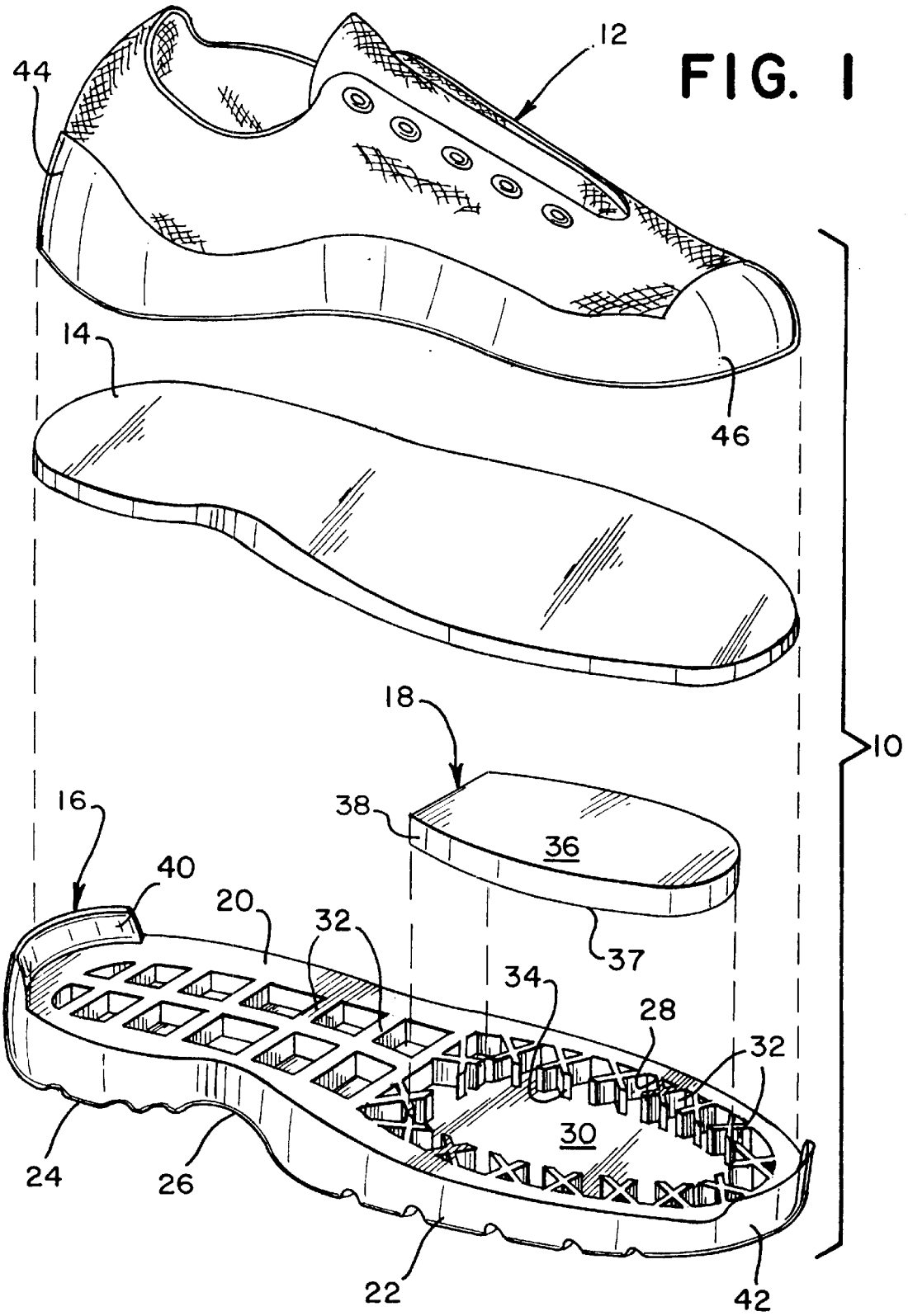
FIG. 1 is an exploded perspective view of the invention in a preferred sports shoe unit, including an upper, a fabric insole and an outsole with a plantar pad, shown prior to assembly.
Figure 2:
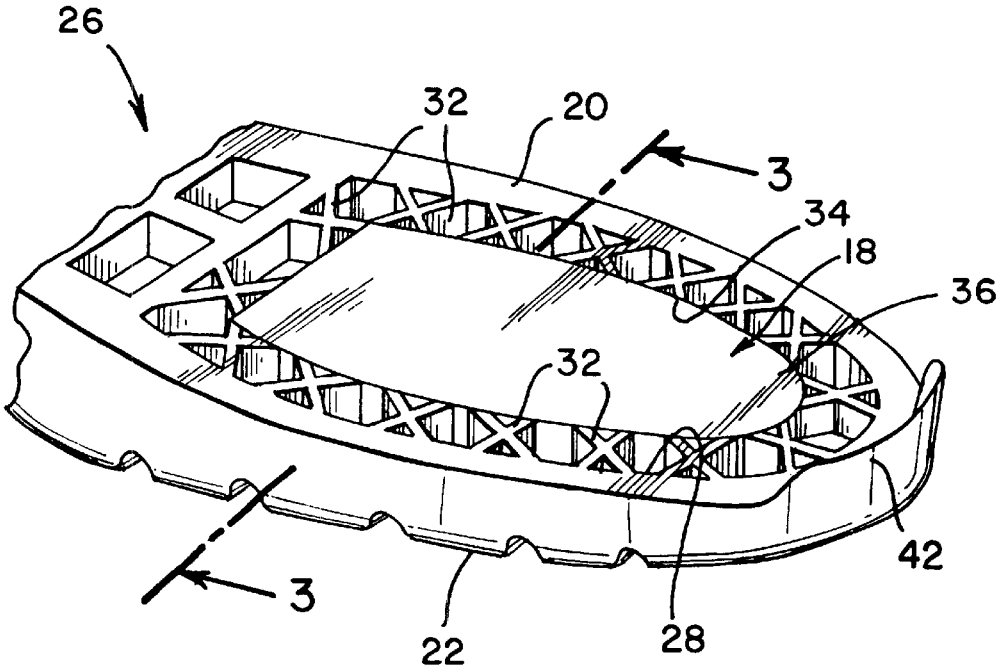
FIG. 2 is a partial perspective view of the internal plantar region of the outsole of FIG. 1, showing the molded-in-place insert of the present invention, formed on to the floor of the plantar cavity.
Figure 3:
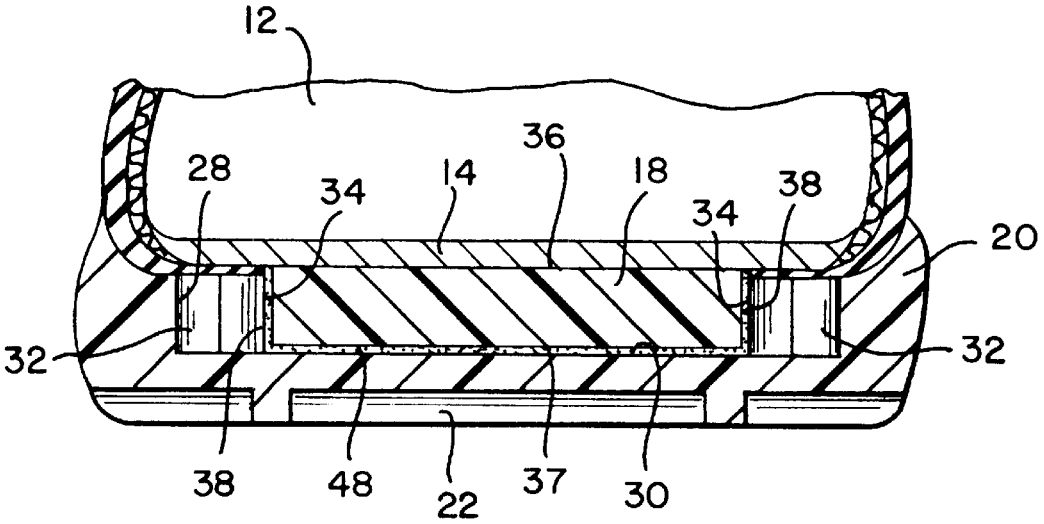
FIG. 3 is a cross-section taken at lines 3—3 of FIG. 2.
Figure 4:
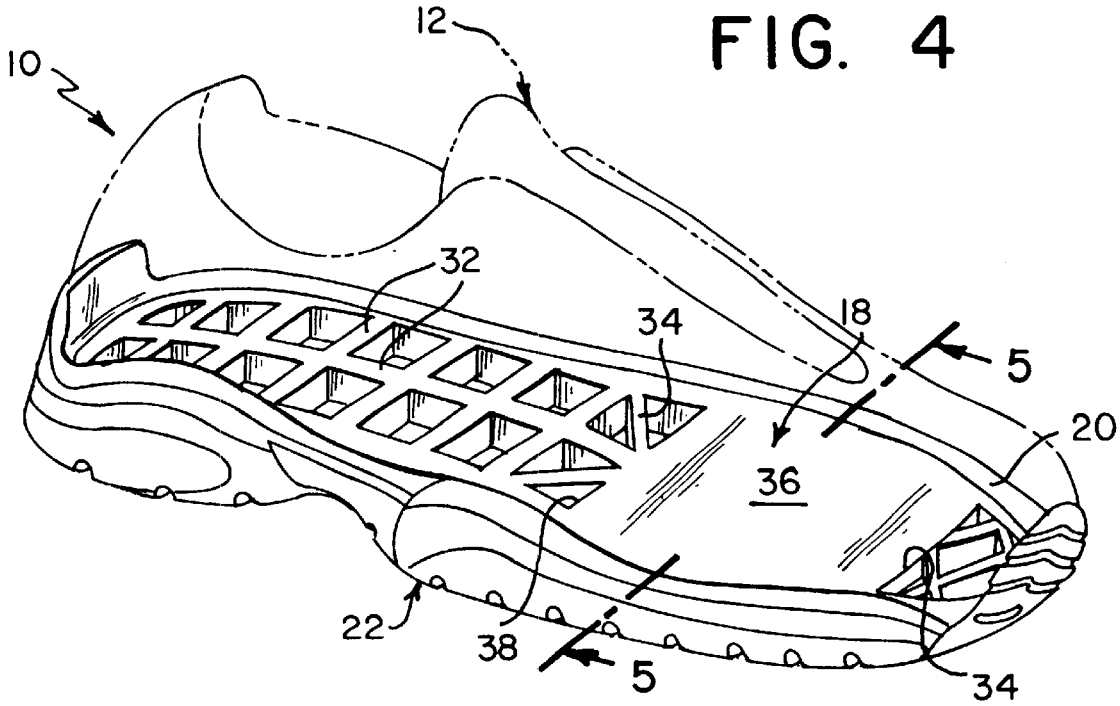
FIG. 4 is a perspective view of a shoe unit showing an alternative construction of the pad of the present invention located in the plantar region of the outsole.

Those skilled in the art will more fully appreciate the above FIGS. 1–3 by a careful reading of the following Detailed Description of one or more preferred embodiments, to which the same pertain.

DETAILED DESCRIPTION

According to the present invention, elements of a preferred form of footwear are generally shown by shoe unit 10, in FIGS. 1–7. More specifically and for purposes of illustration, FIGS. 1–7 generally show one or more elements of only a representative unit 10, while a second unit of the pair of footwear is not shown. Unit 10 consists of an upper, generally shown at 12, an insole 14, an outsole 16 and a pad 18 having a structure and function that shall be detailed below. Those skilled in the art will further appreciate that the present invention could take the form of the sports shoe 10 depicted or, alternatively, the footwear could be a walking shoe, hiking boot or other footwear for active use. Similarly, the materials used for the various elements could be leather or other synthetic materials.

Further according to the subject invention, the outsole 16 of shoe unit 10 has a peripheral wall 20 delimiting a plantar 22, a heel 24 and an arch 26 region of the outsole, respectively. As shown in FIGS. 1–3, an inner cavity 28 is preferably formed in at least one of the plantar 22, heel 24 and arch 26 regions, the cavity having a floor 30. Preferably, cavity 28 is located in the plantar region 22. Pad 18 is a separate cushioning element preferably located within the plantar cavity 28, wherein the pad is molded-in-place to the floor 30 within the cavity to form an integral functional part of the outsole 26.

A plurality of ribs 32 form a structure defining a series of combs that articulate with the peripheral wall 20 of the outsole, the arrangement further delimiting an inner periphery 34 of the cavity 28, wherein the pad 18 is joined to that inner periphery. The ribs 32 are normally present in at least the heel 24 but also may exist in plantar region 22 where they provide added support and integrity to the outsole. Ribs 32 preferably extend diagonally, versus the ribs which are present in the heel that extend longitudinally and transversely along outsole 16. Ribs 32 are preferably injection molded in one piece, together with the outsole 16, from a polymeric material, e. g., Thermal Plastic Rubber (TPR). Pad 18 is preferably injection molded-in-place from a similar or different polymeric material relative as outsole 16. Suitable materials for the pad 18 are preferably selected from the group comprising Ethyl Vinyl Acetate (EVA) and Thermal Plastic Urethane (TPU).

The inner periphery of cavity 28 and pad 18 are sized and shaped to correspond to one another, and to the contours of the peripheral wall 20 of outsole 16. Pad 18 is typically made of EVA, although other resilient, flexible materials are possible as noted above. Pad 18 has an upper surface 36 that is juxtaposed with the insole 14 and an edge 38 that is positioned adjacent the periphery 34 of cavity 28 during assembly of shoe 10. Heel 40 and toe 42 caps are provided to receive a corresponding heel 44 and toe 46 of the upper 12, respectively, for facilitating the adhesive bonding of these structures together. Prior to assembly of the upper 12 and outsole 16, as mentioned above, the pad 18 can be molded in place onto the floor 30 as follows. A preformed pad element 18 is placed in cavity 28 then a layer 48 is applied of a conventional TPR material or one of the preferred materials mentioned above (such as polymeric materials) that adhesively bonds to the bottom 37 and edge 38 surfaces of the pad, acting further to mold these surfaces to the floor 30 and ribs 32 that comprise inner periphery 34 of cavity 28. The pad 18 can also be molded by conventional injection molding, in a relatively simultaneous step along with the outsole 16.

Figure 5:
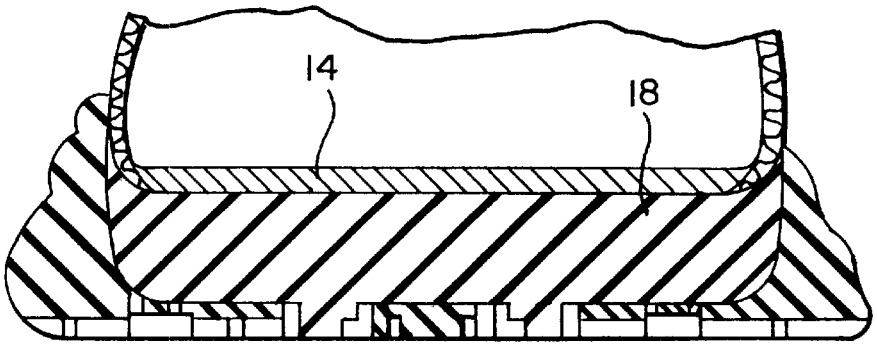
FIG. 5 is a cross sectional view taken substantially along lines 5—5 of FIG. 4.
Figure 6:
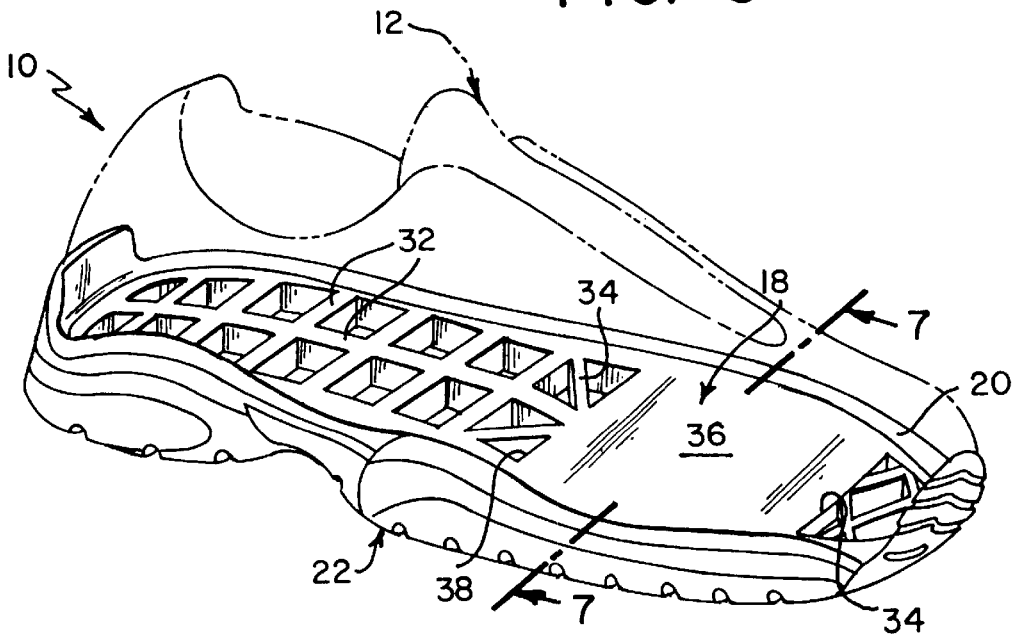
FIG. 6 is a perspective view of a shoe unit showing another, alternative construction of the pad of the present invention located in the plantar region of the outsole.
Figure 7:
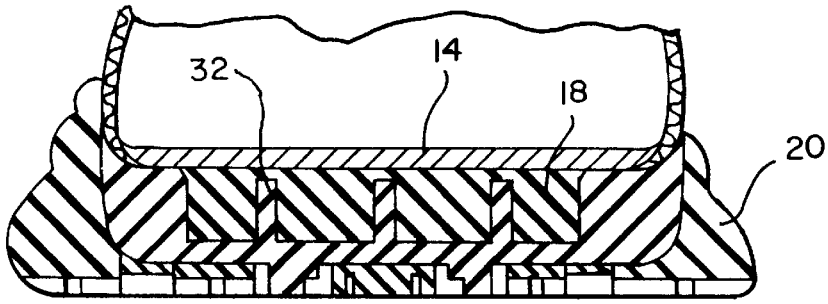
FIG. 7 is a cross sectional view taken substantially along lines 7—7 of FIG. 6.

Referring to FIGS. 5–6, pad 18 extends between peripheral walls 20 and fills cavity 28, whereas FIGS. 6–7 alternatively show ribs 32 being present in plantar region 22 such that the polymeric material of injection molded pad 18 is found within the comb structure between ribs 32. Because the polymeric material of ribs 32 and outsole 16 can be the same or different than pad 18, it is possible to have different regions of outsole 16 with differing densities.

Obviously, other substitutions, modifications and alterations of the embodiments presented herein are made apparent to those skilled in art, without departing from the scope of the present invention. Thus, the description contained in this Specification is intended by way of example rather than limitation vis-a-vis the appended claims.

What is claimed is:

1. A shoe unit comprising:

an outer sole having a peripheral wall delimiting a plantar region, a heel region, and an arch region of the outsole;

an inner cavity formed in at least one of the plantar, heel and arch regions, the cavity having a shape including a floor;

a molded-in-place cushioning pad made of ethyl vinyl acetate (EVA) located within the inner cavity, the cushioning pad having a top, bottom and edge surfaces, wherein the cushioning pad is molded within the cavity prior to the assembly of a shoe upper and the outsole and a thermal plastic rubber (TPR) layer located between the cavity and the cushioning pad to adhesively bond the top and edge surfaces of the cushioning pad to the inner cavity so that the cushioning pad becomes an integral functional part of the outsole.

2. The shoe of claim 1 wherein the pad is located in the plantar region of the outsole.

3. The shoe of claim 1 further comprising a plurality of ribs forming a structure defining a series of combs that articulate with the peripheral wall of the outsole in one or more of the heel, plantar and arch regions with the ribs joined to that inner periphery, wherein the pad is molded in place within the rib structure.

4. The shoe unit of claim 3 wherein the ribs in the plantar region extend diagonally and provide added support and integrity to the outsole and the ribs in the heel region extend longitudinally and transversely along the outsole.

5. The shoe of claim 1 wherein the cushioning pad extends substantially continuously between the peripheral walls of the outsole in the plantar region.

6. The shoe unit of claim 1, the outer sole further comprising a heel cap receiving a corresponding heel of the shoe upper, and a toe cap receiving a corresponding toe of the shoe upper, wherein the heel cap and the toe cap are provided for facilitating bonding of the outer sole and the shoe upper.

7. The shoe unit of claim 1 wherein the pad is molded in place to the floor of the cavity by injection molding.

8. The shoe unit of claim 1, the shoe unit consisting of a sports shoe, a walking shoe, a hiking boot and footwear for active use.

9. The shoe of claim 1 wherein the cavity and the cushioning pad are shaped to correspond to the contours of the peripheral walls of the outsole.

10. Footwear of the type having a shoe upper and an outsole joined together, the footwear comprising:

an outer sole having a peripheral wall delimiting a plantar region, a heel region and an arch region of the outsole;

a cavity formed in the plantar region with a shape including a floor;

a plurality of ribs forming a structure defining a series of combs that articulate with the peripheral wall of the outsole, the ribs further delimiting an inner periphery of the cavity; and a molded-in-place cushioning pad made of ethyl vinyl acetate (EVA) located within the cavity, said cushioning pad having a top, bottom and edge surfaces, wherein the cushioning pad is molded within the cavity prior to the assembly of a shoe upper and the outsole and extends substantially between the peripheral wall and a thermal plastic rubber (TPR) layer located between the cavity and the cushioning pad to adhesively bond to the top and edge surfaces of the cushioning pad to the inner cavity so that the cushioning pad becomes an integral functional part of the outsole.

11. The footwear of claim 10, the outer sole further comprising a heel cap receiving a corresponding heel of the shoe upper, and a toe cap receiving a corresponding toe of the shoe upper, wherein the heel cap and the toe cap are provided for facilitating bonding of the outer sole and the shoe upper.

12. The footwear of claim 10 wherein the ribs extend diagonally and provide added support and integrity to the outsole and the ribs in the heel region extend longitudinally and transversely along the outsole.

13. The footwear of claim 10 wherein the pad is molded in place by injection molding.

14. The footwear of claim 10, the footwear consisting of a sports shoe, a walking shoe, a hiking boot and footwear for active use.

15. A method for making a shoe unit, comprising the steps of:

providing an outer sole having a peripheral wall delimiting a plantar region, a heel region, and an arch region of the outsole;

forming an inner cavity in at least one of the plantar, heel and arch regions, the cavity having a shape including a floor and side walls;

applying a thermal plastic rubber (TPR) layer to the floor and side walls of the cavity; and molding in place a cushioning pad made of ethyl vinyl acetate (EVA) to the floor within the cavity prior to the assembly of a shoe upper and the outsole wherein the cushioning pad includes a top, bottom and edge surfaces so that the TPR layer adhesively bonds the top and edge surfaces of the cushioning pad such that the pad becomes an integral functional part of the outsole.

16. The method of claim 15 further comprising the step of locating the cavity and the cushioning pad in the plantar region of the outsole.

17. The method of claim 15 further comprising the steps of:

providing a plurality of ribs forming a structure and defining a series of combs that articulate with the peripheral wall of the outsole, the ribs further delimiting an inner periphery of the cavity; and joining the cushioning pad to the inner periphery.

18. The method of claim 15 further comprising the step of shaping the cavity and the cushioning pad to correspond to the contours of the peripheral walls of the outsole.

19. The method of claim 18 further comprising the steps of:

diagonally extending the ribs in the plantar region; and longitudinally and transversely extending the ribs in the heel region along the outsole;

wherein added support and integrity to the outsole are provided.

20. The method of claim 15, further comprising the steps of:

providing a heel cap in the outer sole for receiving a corresponding heel of the shoe upper; and providing a toe cap in the outersole for receiving a corresponding toe of the shoe upper;

wherein the heel cap and the toe cap are provided for facilitating bonding of the outer sole and the shoe upper.

21. The method of claim 15 further comprising the step of injection molding the cushioning pad to the floor in the cavity.

* * * * *